US005101515A

United States Patent [19]

Holt et al.

[11] Patent Number: 5,101,515

[45] Date of Patent: Apr. 7, 1992

[54] JACKET PACK

[76] Inventors: Patricia A. Holt, 335 S. Main St., Mansfield, Mass. 02048; Nancy R. Holt, 85 Newton Ave., Warwick, R.I. 02889

[21] Appl. No.: 675,852

[22] Filed: Mar. 27, 1991

[51] Int. Cl.[5] ..... A41D 1/02

[52] U.S. Cl. ..... 2/94; 2/102; 2/247; 2/250; 2/253; 224/148

[58] Field of Search ..... 2/94, 102, 247, 250, 2/253; 219/211, 280, 281, 528; 224/148, 902

[56] References Cited

U.S. PATENT DOCUMENTS

| | | | |
|---|---|---|---|
| 2,066,072 | 12/1936 | Powell | 2/94 |
| 2,579,383 | 12/1951 | Goudsmit | 2/102 |
| 3,529,307 | 9/1970 | Belson et al. | 2/94 |
| 4,220,302 | 9/1980 | Hampton et al. | 224/148 |
| 4,498,613 | 2/1985 | Donahue et al. | 224/148 |
| 4,537,341 | 8/1985 | Kelly | 224/148 |
| 4,637,075 | 1/1987 | Ingrisano et al. | 2/94 |
| 4,669,127 | 6/1987 | Swanson | 2/94 |
| 4,696,066 | 9/1987 | Ball et al. | 2/102 |
| 4,876,724 | 10/1989 | Suzuki | 2/94 |
| 5,014,359 | 5/1991 | Hanson | 2/94 |

FOREIGN PATENT DOCUMENTS

| | | | |
|---|---|---|---|
| 0287294 | 10/1988 | European Pat. Off. | 2/102 |

*Primary Examiner*—Werner H. Schroeder
*Assistant Examiner*—Gloria Hale
*Attorney, Agent, or Firm*—Leon Gilden

[57] ABSTRACT

A jacket construction is arranged to provide support and transport for various infant associated care items, to include a central jacket torso portion formed with a first pocket containing moistened towel members therewithin, with a second pocket containing diaper members, a plurality of third pockets for securing of infant feeding bottles, and fourth pockets for securing infant clothing therewithin.

3 Claims, 4 Drawing Sheets

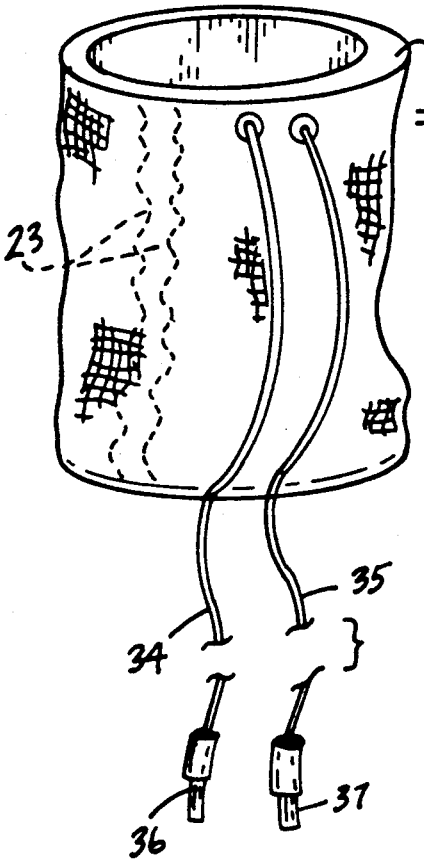
Fig 3
Fig 4
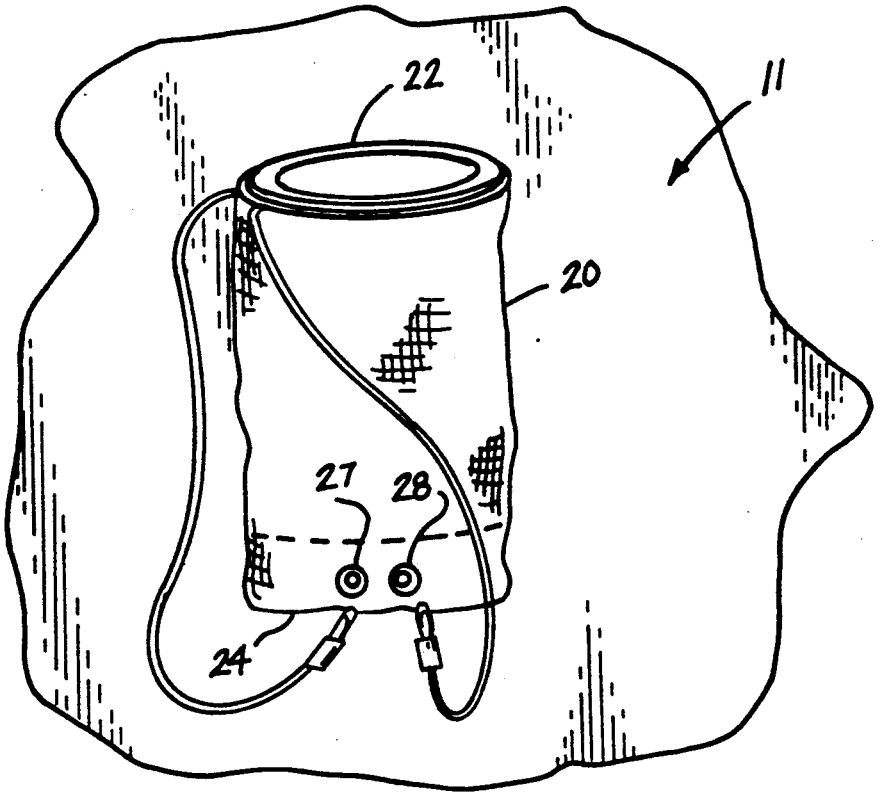

JACKET PACK

BACKGROUND OF THE INVENTION

1. Field of the Invention

The field of invention relates to infant accessory items, and more particularly pertains to a new and improved jacket pack wherein the same is arranged for the storage and transport of infant accessory items therewithin.

2. Description of the Prior Art

Jackets of various constructions have been utilized in the prior art containing various compartments for storage of discrete items to enhance ease in the transport of such items for their ultimate use. Examples of prior art jacket constructions may be found for example in U.S. Pat. No. 4,876,724 to Suzuki wherein a jacket member includes various pockets therewithin for mounting a sound system for effecting selective playing of audio devices U.S. Pat. No. 4,637,075 to Inqrisano, et al. sets forth a medical services jacket wherein a vest-type construction includes various medical devices thereon.

U.S. Pat. No. 4,502,155 to Itoi sets forth an outerwear garment for hiking and the like utilizing various pockets for mounting and containing various devices therewithin.

U.S. Pat. No. 4,637,076 to Tartt, et al. sets forth a vest member which is convertible between a vest garment and a bag configuration in use.

As such, it may be appreciated that there continues to be a need for a new and improved jacket pack as set forth by the instant invention which addresses both the problems of ease of use as well as effectiveness in construction and in this respect, the present invention substantially fulfills this need.

SUMMARY OF THE INVENTION

In view of the foregoing disadvantages inherent in the known types of jacket members now present in the prior art, the present invention provides a jacket pack wherein the same is arranged for storing and transporting accessory items for use in attending infants and for maintaining these items in a convenient and readily usable manner. As such, the general purpose of the present invention, which will be described subseguently in greater detail, is to provide a new and improved jacket pack which has all the advantages of the prior art jacket organizations and none of the disadvantages.

To attain this, the present invention provides a jacket construction arranged to provide support and transport for various infant associated care items to include a central jacket torso position formed with a first pocket containing moistened towel members therewithin, with a second pocket containing diaper members, a plurality of third pockets for securing of infant feeding bottles, and fourth pockets for securing infant clothing therewithin.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved jacket pack which has all the advantages of the prior art jacket organizations and none of the disadvantages.

It is another object of the present invention to provide a new and improved jacket pack which may be easily and efficiently manufactured and marketed.

It is a further object of the present invention to provide a new and improved jacket pack which is of a durable and reliable construction.

An even further object of the present invention is to provide a new and improved jacket pack which is susceptible of a low cost of manufacture with regard to both materials and labor, and which accordingly is then susceptible of low prices of sale to the consuming public, thereby raking such jacket packs economically available to the buying public.

Still yet another object of the present invention is to provide a new and improved jacket pack which provides in the apparatuses and methods of the prior art some of the advantages thereof, while simultaneously overcoming some of the disadvantages normally associated therewith.

Still another object of the present invention is to provide a new and improved jacket pack wherein the same is arranged for securing various accessory items in a convenient and readily available manner for use in attending and servicing infant children.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is an isometric illustration of a heating insert utilized with a jacket of the instant invention.

FIG. 4 is an isometric illustration of the heating insert mounted within an associated pocket of the jacket of the instant invention.

DESCRIPTION OF THE PREFERRED EMBODIMENT

Figure 1:
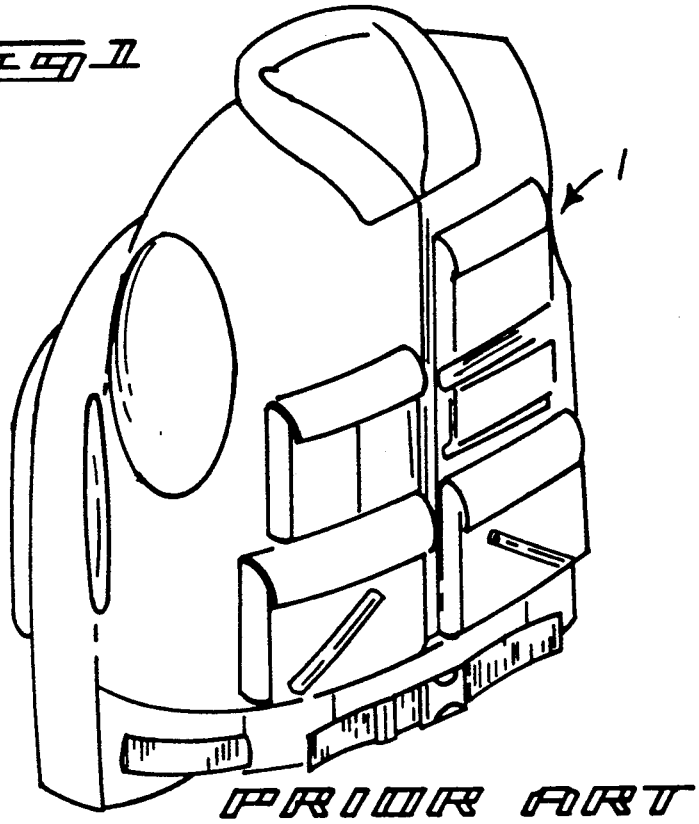
FIG. 1 is an isometric illustration of a prior art jacket construction.
Figure 2:
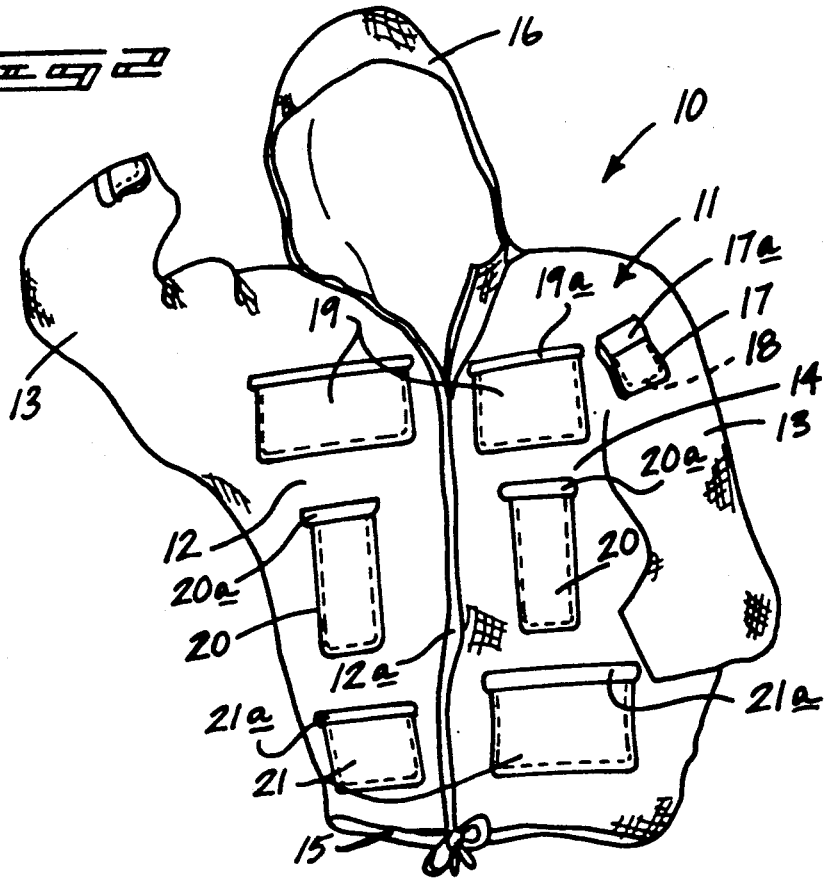
FIG. 2 is an orthographic frontal view of the jacket construction of the instant invention.

With reference now to the drawings, and in particular to FIGS. 1 to 8 thereof, a new and improved jacket pocket embodying the principles and concepts of the present invention and generally designated by the reference numeral 10 will be described.

FIG. 1 illustrates a typical prior art jacket construction 1, as typified in U.S. Pat. No. 4,669,127, wherein the garment includes a vest-shaped member formed with various cargo pockets mounted to surfaces of the vest construction.

More specifically, the jacket pack 10 of the instant invention essentially comprises a jacket, including a jacket torso portion 11, wherein the torso portion 11 includes a right chest torso covering web 12 and a left chest torso covering web 14 that are secured selectively together by a covering web connection strip 12*a*. The strip 12*a* may be formed of a conventional fastener, such as buttons, a zipper or zippers, hook and loop fasteners, and the like. A jacket arm sleeve 13 is mounted to the jacket torso portion 11 to each of the right and left chest torso covering webs 12 and 14. A drawstring 15 is positioned at a lower terminal end of the jacket torso portion 11 for a gathering or securement of the jacket torso portion 11 about an individual. A hood 16 is formed at an upper terminal end of the jacket torso portion 11, as required, for a covering of an individual's head if desired.

The jacket torso portion 11 includes a first pocket member 17 formed at a junction of the jacket arm sleeve 13 and the jacket torso portion 11 to secure cleaning fluid moistened towel members 18 therewithin. A covering flap 17*a* is provided to overlie the first pocket member 17. Second chest pockets 19 to secure diaper members therewithin are positioned at upper end portions of the right and left chest torso covering webs 12 and 14 respectively, and include third chest pocket covering flaps 20*a* to overlie those pockets. Third chest pockets 20 are formed in alignment with and underlying the second chest pockets 19. onto each of the covering webs 12 and 14, with fourth chest pockets 21 that include fourth chest pocket covering flaps 21*a* positioned in alignment with and below the second and third chest pockets 19 and 20.

Figure 5:
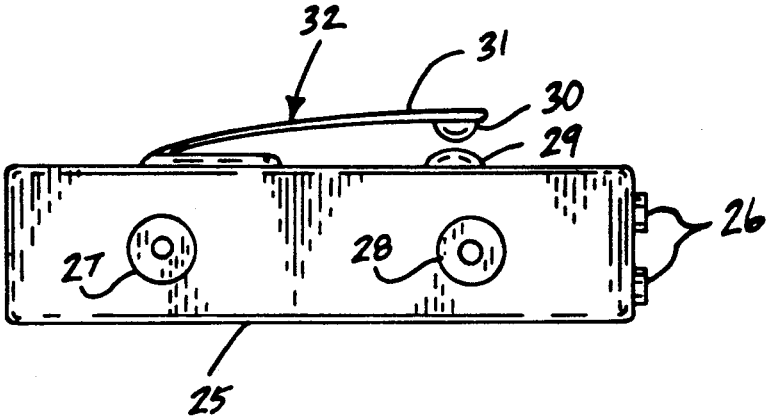
FIG. 5 is an orthographic side view of a switch member utilized by the instant invention.
Figure 6:
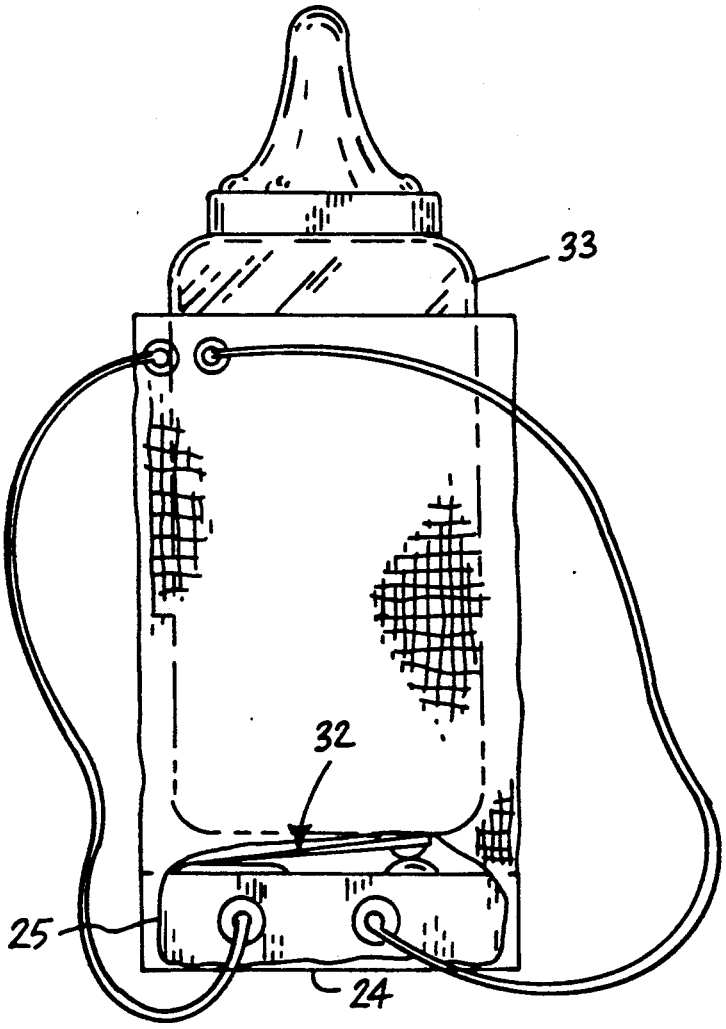
FIG. 6 is an orthographic side view, taken in elevation, of a modified construction in association with a pocket construction of the instant invention.

FIG. 4 illustrates an enlarged isometric illustration of a specialized use of the third chest pockets 20 to receive tubular heating jackets 22 therewithin. The tubular heating jackets 22 include electrical resistance heating coils 23 (see FIG. 3) extending coextensively about the tubular heating jackets 22. The heating coils 23 are in electrical communication with first and second respective electrical transmission lines 34 and 35, wherein the transmission lines include respective first and second connector plugs 36 and 37 at outer terminal ends thereof. Reference to FIGS. 4-6 for example illustrate that a battery pack housing 25 is mounted on the third pocket floor 24 of each of the third chest pockets 20. The battery pack housing 25 includes a plurality of battery members 26 and a respective first and second connector receptacle 27 and 28 to receive the respective first and second connector plugs 36 and 37 to effect electrical communication and heating of the associated infant feeding container 33 (see FIG. 6) when the heating container is positioned on the switch member 32 with the battery pack housing. The switch member 32 is provided to only direct electrical current into the tubular heating jacket 22 upon presence of a container 33 with fluid therewithin for heating. The connector plugs 36 and 37 are selectively removable relative to the first and second connector receptacles 27 and 28 that project through an outer wall of fabric web of the third chest pockets to discontinue heating when desired in the presence of a container 33 with fluid therewithin. The switch member 32 includes a first switch contact member 29 mounted on the battery pack housing 25, with a second switch contact member 30 mounted on a spring biased arm 31 that normally biases and spaces the second switch contact member 30 relative to the first switch contact member 29 to only permit completion of a conventional direct current electrical circuit and direct such current to the tubular heating jacket 22. The battery members 36 within the battery pack housing 25 are replaceable in a conventional manner.

Figure 7:
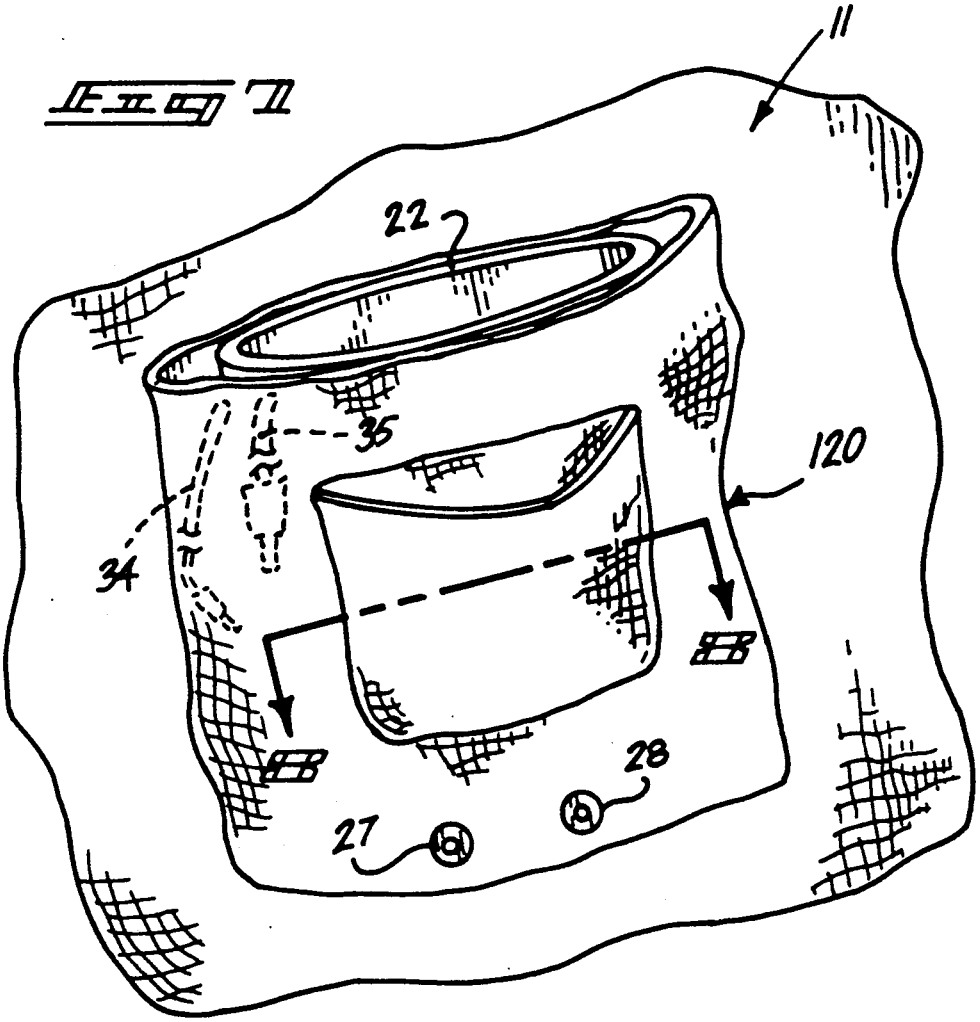
FIG. 7 is an isometric illustration of a further modified pocket construction utilized by the instant invention.
Figure 8B:
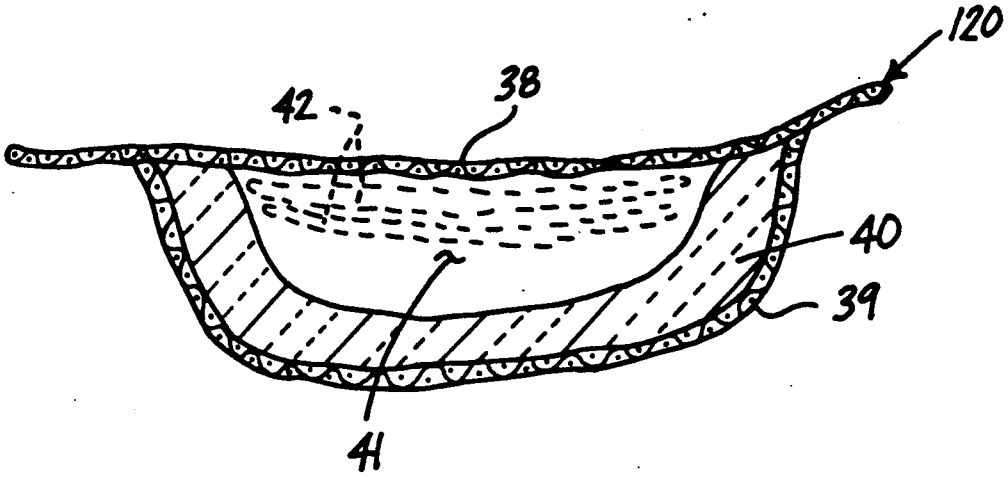
FIG. 8 is an orthographic view, taken along the lines 8—8 of FIG. 7 in the direction indicated by the arrows.

Reference to FIGS. 7 and 8 illustrate the use of a further modified third chest pocket 120 that includes a further third chest pocket 41 mounted to an outer surface of the fabric pocket web 38 (see FIG. 8). The fabric pocket web 38 includes a further pocket web 39 secured to an outer surface thereof, wherein the further pocket web 39 includes an insulative layer 40 mounted to an interior surface of the further pocket web 39 in confrontation with the fabric pocket web 38 to define the further third chest pocket 41 to thereby contain and secure moistened towel members 42 within the further third chest pocket to heat such towel members for added comfort and convenience to an infant and derive such heat through the fabric pocket web 38 when the tubular heating jacket 22 is utilized.

It should be further understood that the second, third, and fourth chest pockets mounted on the jacket torso portion 11 are in alignment relative to one another to maintain balance of the jacket pack construction when used by an individual. The first pocket member 17 is of a diminished size relative to the second, third, and fourth chest pockets as to not alter the balance of the jacket pack construction when worn by an individual.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by letters patent of the United States is as follows:

1. A jacket pack construction, comprising, a jacket torso covering portion, wherein the jacket torso covering portion includes a right chest torso covering web and a left chest torso covering web, wherein a covering web connector strip is mounted to the right chest torso covering web and the left chest torso covering web for selective securement of the right chest torso covering web and the left chest torso covering web together, and a first pocket member mounted to one of the covering webs adjacent an arm opening of one of said covering webs, and the first pocket member includes a plurality of cleaning fluid moistened towel members therewithin, and a plurality of second pocket members, wherein at least one of said second pocket members is mounted to an upper portion of the right and left chest torso covering webs, and a plurality of third chest pockets, and at least one of the plurality of third chest pockets positioned on each of the right and left chest torso covering webs aligned with and underlying one of said second chest pockets, and the third chest pockets include a selectively removable infant feeding container therewithin, and a plurality of fourth chest pockets, and at least one of the plurality of fourth chest pockets positioned underlying one of the third chest pockets on each of the right and left chest torso covering webs and wherein each of the third chest pockets includes a tubular heating jacket positioned within the third chest pockets, and each of the third chest pockets further includes a third chest pocket floor, and a battery pack housing positioned on each of the third chest pocket floors underlying the tubular heating jacket, and the tubular heating jacket includes electrical resistance heating coils directed through the tubular heating jacket coextensively thereabout, and a respective first and second electrical transmission line in electrical communication with the electrical resistance heating coils extending exteriorly of the tubular heating jacket, and a respective first and second connector plug mounted to the respective first and second electrical transmission lines, and the battery pack housing includes a respective first and second connector receptacle for respectively receiving the first and second connector plugs.

2. A construction as set forth in claim 1 wherein the battery pack housing further includes a plurality of battery members, and a switch member to selectively direct current from the battery members to the first and second connector receptacle, and the switch member includes a first switch contact member fixedly mounted to a top surface of the battery pack housing, and a spring biased arm mounted to the top surface of the battery pack housing spaced above the battery pack housing, and a second switch contact member mounted to the spring biased arm positioned overlying the first switch contact member, whereupon a fluid filled feeding container directed within the tubular heating jacket directs force to the spring biased arm to effect electrical communication between the first switch contact member and the second switch contact member.

3. A construction as set forth in claim 2 wherein each third chest pocket includes a fabric pocket web directed exteriorly and forwardly of the jacket torso portion, and the fabric pocket web includes a further pocket web mounted forwardly of the fabric pocket web and the further pocket web includes an insulative layer mounted to an interior surface of the further pocket web and the fabric pocket web to define a further third chest pocket between the fabric pocket web and the insulative layer, and a plurality of towel members positionable within the further third chest pocket for selective heating of the towel members upon heating of a tubular heating jacket by the battery pack housing.

* * * * *